US008960869B2

(12) United States Patent
Takada et al.

(10) Patent No.: US 8,960,869 B2
(45) Date of Patent: Feb. 24, 2015

(54) TANK AND PRINTER INCLUDING TANK

(75) Inventors: Hitoshi Takada, Yokohama (JP); Yasuo Kotaki, Yokohama (JP); Koichi Kubo, Yokohama (JP); Hiroki Hayashi, Kawasaki (JP); Tatsuo Nanjo, Kawasaki (JP); Takeho Miyashita, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 13/574,562

(22) PCT Filed: Feb. 16, 2011

(86) PCT No.: PCT/JP2011/000857

§ 371 (c)(1),
(2), (4) Date: Jul. 20, 2012

(87) PCT Pub. No.: WO2011/121878

PCT Pub. Date: Oct. 6, 2011

(65) Prior Publication Data

US 2012/0300003 A1 Nov. 29, 2012

(30) Foreign Application Priority Data

Apr. 2, 2010 (JP) ..... 2010-085990
Aug. 24, 2010 (JP) ..... 2010-187156

(51) Int. Cl.
*B41J 2/175* (2006.01)

(52) U.S. Cl.
CPC ..... *B41J 2/1752* (2013.01); *B41J 2/17513* (2013.01); *B41J 2/17523* (2013.01)
USPC ..... 347/86

(58) Field of Classification Search
CPC . B41J 2/17556; B41J 2/17526; B41J 2/17506
USPC ..... 347/86
See application file for complete search history.

(56) References Cited

U.S. PATENT DOCUMENTS

| | | | | |
|---|---|---|---|---|
| 5,341,160 | A * | 8/1994 | Winslow et al. | 347/86 |
| 5,721,577 | A * | 2/1998 | Ostermeier et al. | 347/86 |
| 6,139,138 | A * | 10/2000 | Powers et al. | 347/92 |
| 6,170,939 | B1 | 1/2001 | Ujita et al. | 347/86 |
| 6,443,567 | B1 | 9/2002 | Hayashi et al. | 347/85 |

(Continued)

FOREIGN PATENT DOCUMENTS

| | | |
|---|---|---|
| CN | 1351542 | 5/2002 |
| CN | 1603122 | 4/2005 |

(Continued)

OTHER PUBLICATIONS

International Preliminary Report on Patentability (Chapter I) issued in international Application No. PCT/JP2011/000857.

(Continued)

*Primary Examiner* — Matthew Luu
*Assistant Examiner* — Patrick King
(74) *Attorney, Agent, or Firm* — Fitzpatrick, Cella, Harper & Scinto

(57) ABSTRACT

The invention is to prevent positional deviation of a sealing valve, improve bubble releasability during atmosphere introduction, and stably supply ink to a recording head. The configuration is provided with an opening 270 on an upper portion of a cylindrical regulating body 165 of a joint base 140 in a state where an ink tank 100 is mounted on a connection unit 10 of a printer.

10 Claims, 12 Drawing Sheets

(56) References Cited

U.S. PATENT DOCUMENTS

| | | | | |
|---|---|---|---|---|
| 6,502,917 | B1 * | 1/2003 | Shinada et al. | 347/19 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,342 | B2 | 4/2003 | Koshikawa et al. | 347/86 |
| 6,550,898 | B2 | 4/2003 | Hayashi et al. | 347/85 |
| 6,550,899 | B1 * | 4/2003 | Cowger et al. | 347/86 |
| 6,598,963 | B1 | 7/2003 | Yamamoto et al. | 347/85 |
| 6,719,415 | B1 | 4/2004 | Hattori et al. | 347/86 |
| 6,805,434 | B2 | 10/2004 | Hayashi et al. | 347/85 |
| 6,824,258 | B2 * | 11/2004 | Yamamoto et al. | 347/86 |
| 6,874,873 | B2 * | 4/2005 | Thielman et al. | 347/85 |
| 7,114,801 | B2 * | 10/2006 | Hall et al. | 347/92 |
| 7,213,914 | B2 * | 5/2007 | Anma et al. | 347/86 |
| 7,364,281 | B2 * | 4/2008 | Yan | 347/85 |
| 7,938,523 | B2 * | 5/2011 | Aldrich | 347/92 |
| 8,272,725 | B2 * | 9/2012 | Tsukamura | 347/86 |
| 8,297,739 | B1 * | 10/2012 | Kodama et al. | 347/49 |
| 2002/0051044 | A1 * | 5/2002 | Sasaki et al. | 347/86 |
| 2004/0017448 | A1 * | 1/2004 | Murakami et al. | 347/86 |
| 2004/0100540 | A1 * | 5/2004 | Hatasa et al. | 347/86 |
| 2005/0068391 | A1 | 3/2005 | Inoue et al. | 347/86 |
| 2005/0088497 | A1 * | 4/2005 | Katayama et al. | 347/86 |
| 2005/0134661 | A1 | 6/2005 | Miyazawa | 347/86 |
| 2005/0185034 | A1 * | 8/2005 | Anma et al. | 347/86 |
| 2006/0146107 | A1 * | 7/2006 | Tsurui et al. | 347/86 |
| 2006/0284946 | A1 * | 12/2006 | Miyazawa | 347/85 |
| 2007/0052776 | A1 * | 3/2007 | Guhse et al. | 347/86 |
| 2007/0070137 | A1 | 3/2007 | Hattori et al. | 347/86 |
| 2007/0236548 | A1 * | 10/2007 | Ohira | 347/86 |
| 2007/0257974 | A1 * | 11/2007 | Hatasa et al. | 347/85 |
| 2008/0231676 | A1 | 9/2008 | Shimizu | 347/86 |
| 2009/0096849 | A1 | 4/2009 | Kanbe et al. | 347/86 |
| 2009/0141105 | A1 | 6/2009 | Sasaki | 347/86 |
| 2009/0141106 | A1 | 6/2009 | Takagi | 347/86 |
| 2012/0056955 | A1 * | 3/2012 | Kodama et al. | 347/86 |

FOREIGN PATENT DOCUMENTS

| | | |
|---|---|---|
| EP | 2 070 706 | 6/2009 |
| JP | 2001-001540 | 1/2001 |
| JP | 2001-328278 | 11/2001 |
| JP | 2004-291246 | 10/2004 |
| JP | 2009-132120 | 6/2009 |
| WO | 00/03877 | 1/2000 |
| WO | 2008/041655 | 4/2008 |

OTHER PUBLICATIONS

Chinese Office Action dated Apr. 2, 2014 in counterpart Chinese Patent Application No. 201180013626.0, and English language translation.

* cited by examiner

TANK AND PRINTER INCLUDING TANK

TECHNICAL FIELD

The present invention relates to a tank for storing ink used for an ink jet printer, and an ink jet printer which performing recording by discharging the stored ink. Further, the present invention relates to a tank used for an ink jet printer that consumes a large amount of ink, and an ink jet printer having such a tank removably mounted thereon.

BACKGROUND ART

In ink jet printers that consume large amounts of ink, a stationary type of ink tank is employed. When this type of ink tank is used, the configuration of a connection body for ink supply provided on the ink jet printer side can be broadly classified into two types.

One type uses a needle-shaped body as the connection body. In this type, ink is supplied by sticking the needle-like body into a rubber seal provided in an ink supply port in the ink tank. The other type uses a tube-shaped body as the connection body. In this type, a cylindrical regulating body, which includes a valve and a spring-shaped elastic member that urges the valve toward an ink supply port, is fixed to the ink supply port in the ink tank. Ink is supplied by causing the valve to be moved against a spring force by the tube-shaped body and to open the ink supply port.

The invention described in Japanese Patent Application Laid-Open No. 2004-291246 is an example of the latter of the two types described above. In this configuration, the ink is stored in a bag-shaped ink storage body. The bag-shaped ink storage body collapses as the ink is supplied.

On the other hand, the invention described in WO2000/003877 pamphlet is another example of the latter of the two types described above. In this configuration, the ink is directly stored in a rigid housing. A printer connection body includes an ink lead-out port and an air introduction port. Air is introduced into the ink tank from the air introduction port while the ink is being supplied from the ink lead-out port.

According to a drawing illustrating an embodiment described in WO2000/003877 pamphlet (FIG. 14 attached to the present specification), in the relationship between a sealing valve 403 and a spring 404 in a connection portion between a main tank 401 and an ink tank unit 402, an opening 405 is formed above the sealing valve 403, and the position of the upper portion of the sealing valve 403 is not regulated. Therefore, there is a possibility that the position of the sealing valve 403 deviates during the opening and closing of the sealing valve 403. There is consequently the problem that it is difficult to maintain the seal properties of the connection portion between the main tank 401 and the ink tank unit 402.

In addition, if the ink tank itself is accidentally dropped, the position of the sealing valve deviates as described above, so that the problem of ink splattering onto a user or the floor can occur.

Concerning this problem, the problem can be resolved by configuring in the same manner as in a drawing illustrating an embodiment described in Japanese Patent Application Laid-Open No. 2004-291246 (FIG. 15 attached to the present specification). Specifically, the problem can be resolved by extending a connection portion 401*a* between the main tank 401 and the sealing valve 403 to block the opening 405 above the sealing valve 403.

In the case where the connection portion 503 illustrated in FIG. 15, which includes a sealing valve 501 and a spring 502, is applied to the exemplary configuration in the FIG. 14 like that described in WO2000/003877 pamphlet, the configuration lacks an opening above the sealing valve. Therefore, bubble releasability from the connection portion 503 deteriorates when ink supply (arrow P) is performed simultaneously with air introduction (arrow Q), so that there is a risk that the ink cannot be stably supplied to a liquid discharge recording portion.

CITATION LIST

Patent Literature

PTL 1: WO2000/003877 pamphlet

PTL 2: Japanese Patent Application Laid-Open No. 2004-291246

SUMMARY OF INVENTION

Technical Problem

The present invention was made in view of the such problems. Accordingly, it is an object of the present invention to provide a tank, and a printer including such tank, that can prevent positional deviation of a sealing valve, improve bubble releasability from a connection portion 503 during atmosphere introduction, and stably supply ink to a recording head.

Solution to Problem

To achieve the above object, one aspect of the invention is a tank comprising: a housing for storing a liquid; a liquid supply port; a valve which is arranged in the housing, and is urged by an elastic member toward the liquid supply port to close the liquid supply port; and a regulating body, which includes the elastic member and the valve thereinside, for regulating movement of the valve, wherein in a state in which a supply tube passes through the liquid supply port and is inserted into an inner side of the regulating body, atmosphere is introduced into the housing from the supply tube and a liquid is led out from the supply tube, the liquid supply port is positioned on a side face adjacent to a bottom face of the housing, and the regulating body extends along a bottom face of the housing and includes an opening on an upper portion in a vertical direction.

Another aspect of the invention is a printer comprising: a liquid discharge head for discharging a liquid; a tank which includes a housing for storing a liquid that is discharged by the liquid discharge head, a liquid supply port for supplying a liquid externally from the housing, a valve which is arranged in the housing and is urged by an elastic member toward the liquid supply port to close the liquid supply port, and a regulating body which includes the elastic member and the valve thereinside and which regulates movement of the valve; and a connection unit to which the tank is connected, which includes a supply tube that is inserted through the liquid supply port into an inner side of the regulating body when the tank is connected, the supply tube having a liquid lead-out port for leading out a liquid from inside the housing to the liquid discharge head and an atmosphere introduction port for introducing atmosphere into the housing along with the leading-out of the liquid, wherein the liquid supply port is positioned on a side face adjacent to a bottom face of the housing, and the regulating body extends along the bottom face of the housing and includes an opening on an upper portion in a vertical direction, the supply tube is configured so that the liquid lead-out port is arranged downwards and the atmosphere introduction port is arranged upward with respect to the vertical direction, and in a state in which the tank is connected to the connection unit and the supply tube passes through the liquid supply port and is inserted into an inner side of the regulating body, the opening of the regulating body is configured so as to face the atmosphere introduction port of the supply tube.

Advantageous Effects of Invention

According to the present invention, deviation of the valve for closing the liquid supply port of a tank can be prevented, bubble releasability during atmosphere introduction of the bubbles that are produced when supplying the liquid from the tank can be improved, and the liquid can be stably supplied to a liquid discharge head.

Further features of the present invention will become apparent from the following description of exemplary embodiments with reference to the attached drawings.

DESCRIPTION OF EMBODIMENTS

First Embodiment

A first embodiment according to the present invention will now be described with reference to the drawings. The first embodiment will be described using as examples an ink jet printer that performs recording by discharging ink toward a recording medium and the ink tank that is used for this printer. However, these are merely examples. The shape, configuration, and materials of these examples may be changed in any way, so long as such a change does not depart from the concept of the present invention. Further, except for FIGS. 3 and 4, the drawings illustrate an ink tank. However, this was done for convenience so that the ink tank configuration according to the embodiment of the present invention could be illustrated in a simplified or schematic manner.

Printer Configuration

The configuration of the ink jet printer (hereinafter, "printer") according to the present embodiment will now be described with reference to FIGS. 1 and 2.

Figure 1:
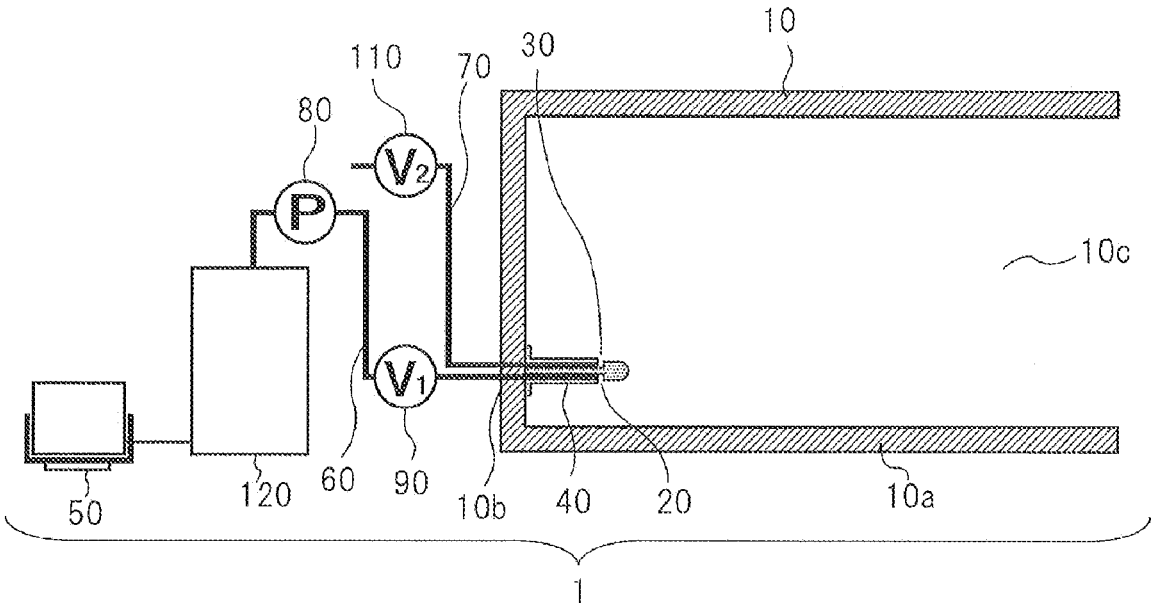
FIG. 1 is a schematic diagram explaining the configuration of the ink jet printer according to the invention.
Figure 2:
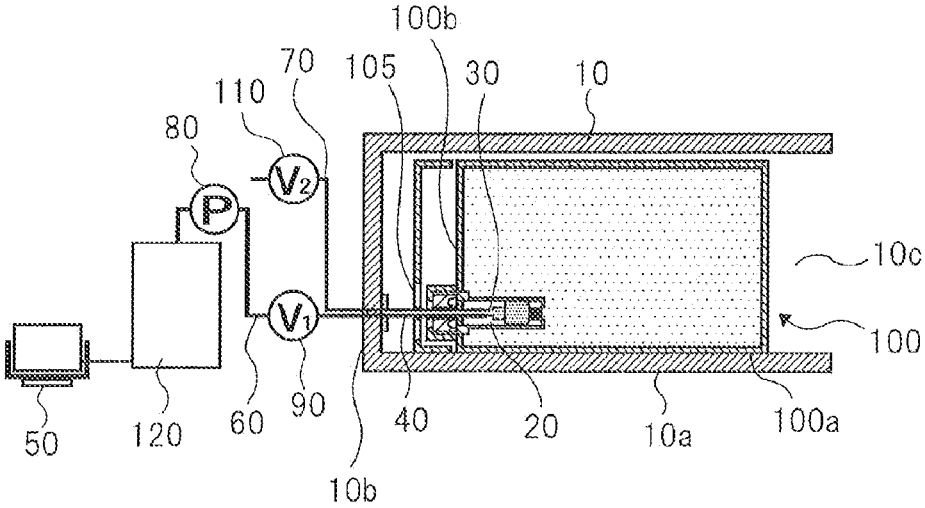
FIG. 2 is a schematic diagram explaining a state where the ink tank is mounted on the ink jet printer.

A printer 1 illustrated in FIGS. 1 and 2 comprises an ink tank connection unit 10 as a housing that can removably accommodate an ink tank 100, a supply tube 40 having an ink lead-out port 20 that is a liquid lead-out port for extracting ink from the ink tank 100 and an atmosphere introduction port 30 for taking in atmosphere, an ink tube 60 for supplying extracted ink to a recording head 50, and an atmosphere tube 70 for bringing atmosphere into the ink tank. The recording head 50, which is a liquid discharge head, has a plurality of ink discharge nozzles for emitting or discharging ink liquid droplets toward a recording medium.

A pump 80 is provided midway along the ink tube 60. Ink from the ink tank 100 attached to the ink tank connection unit 10 is extracted via the ink tube 60 and the supply tube 40 due to a suction action by the pump 80. A first valve 90 is provided on the ink tube 60 between the pump 80 and the supply tube 40. The first valve 90 is configured so as to open during ink supply. The extracted ink is stored in a sub-tank 120 provided on the recording head 50 side, and is fed to the recording head 50.

The atmosphere tube 70 is connected to the supply tube 40. The atmosphere tube 70 is open to the atmosphere at its side opposite to the side connected to the supply tube 40, and may optionally be opened and closed by a second valve 110.

When the printer 1 is placed on a horizontal plane, a bottom face 10*a* of the housing of the ink tank connection unit 10 is positioned horizontally. Further, on the side opposite to a side face 10*b* of the housing, the ink tank connection unit 10 has an opening 10*c* through which the ink tank 100 can be freely taken in and out. Obviously, a cover member or the like can optionally be attached to the opening 10*c*. The ink tank 100 is mounted in an approximately horizontal direction from the opening 10*c* toward the housing interior of the ink tank connection unit 10. Further, the ink tank 100 has an ink supply port 105 on the face that is at the front when the ink tank 100 is mounted and on the side face 100*b* adjacent to an ink tank bottom face 100*a*.

In addition, the supply tube 40, which includes the ink lead-out port 20 and the atmosphere introduction port 30 on its tip side, protrudes toward the inner side of the housing from the side face 10*b* adjacent to the bottom face 10*a* of the ink tank connection unit 10. In the supply tube 40, there are two flow paths having an ink lead-out port 20 and an atmosphere introduction port 30. The flow path having the ink lead-out port 20 is connected to the ink tube 60, and the flow path having the atmosphere introduction port 30 is connected to the atmosphere tube 70.

The ink lead-out port 20 of the supply tube 40 is positioned on a lower portion (on a lower side in a substantially vertical direction) of the supply tube 40, and the atmosphere introduction port 30 is positioned on an upper portion (on an upper side in the substantially vertical direction) of the supply tube 40.

Ink Tank Configuration

Figure 3:
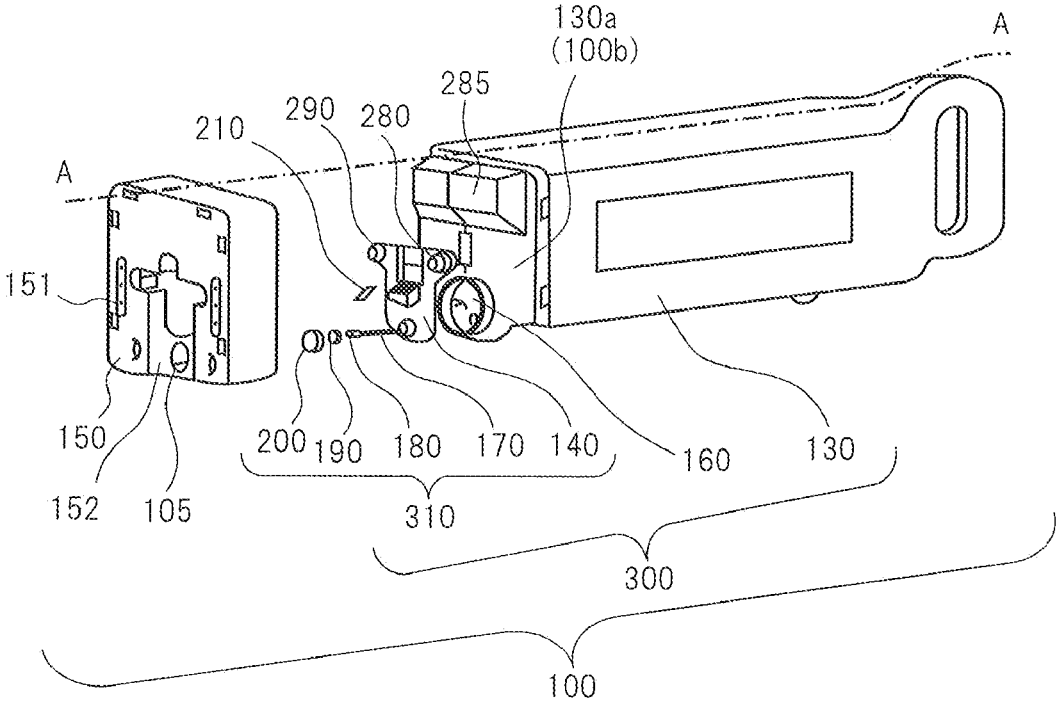
FIG. 3 is an exploded perspective view for explaining the configuration of the ink tank according to the invention.
Figure 4:
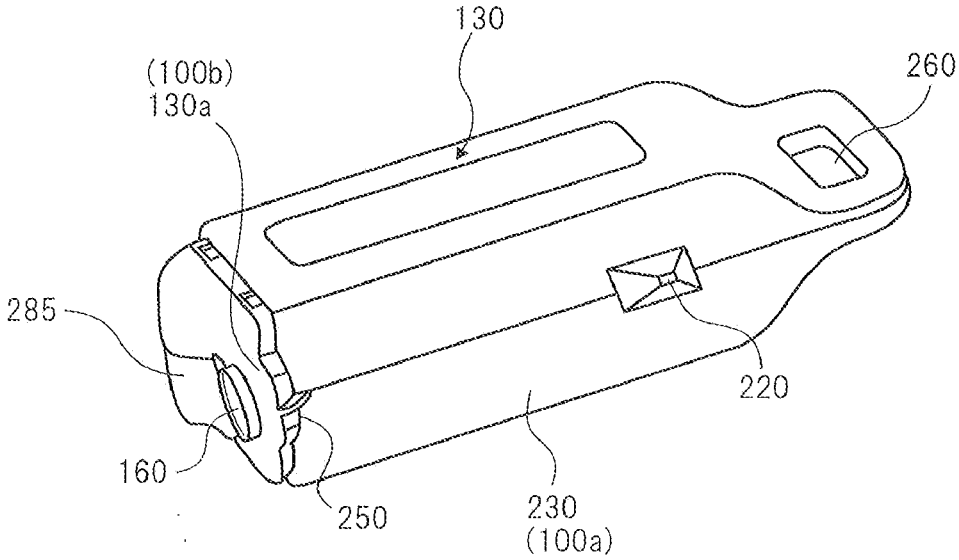
FIG. 4 is a perspective view explaining a shape of the housing of the ink tank according to an embodiment of the invention.
Figure 5:
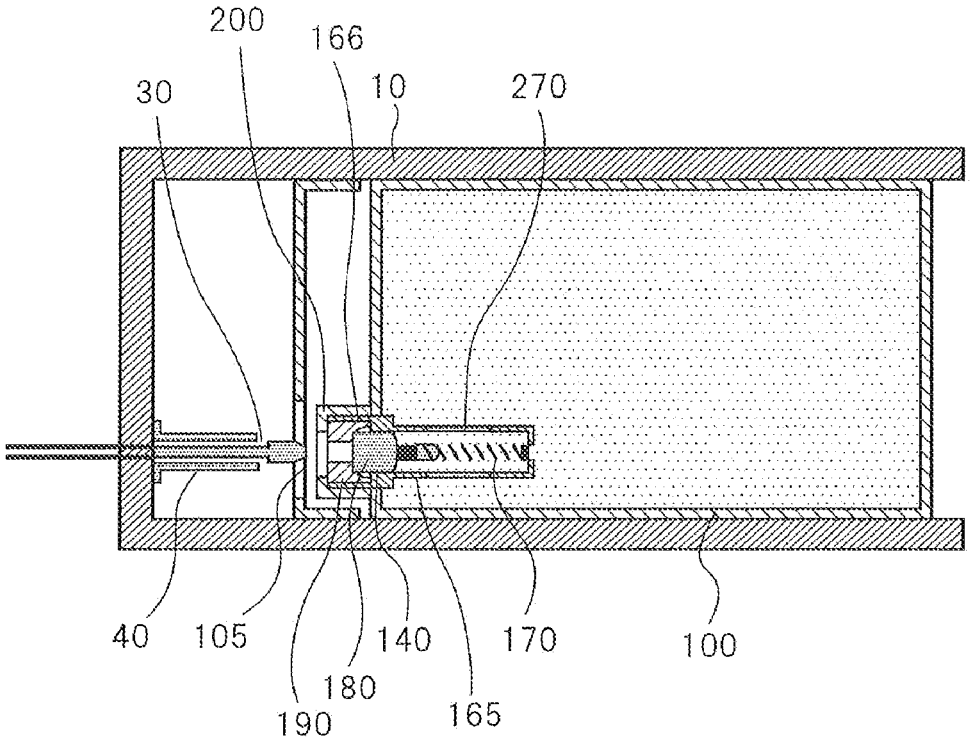
FIG. 5 is a schematic diagram explaining the configuration of the joint unit of ink tank according to an embodiment of the invention.

Next, the configuration of the ink tank according to the present embodiment will be described with reference to FIGS. 3 to 5. FIG. 3 is an exploded perspective view of the ink tank according to the present embodiment corresponding to the ink tank 100 schematically illustrated in FIG. 2. FIG. 4 is a perspective view illustrating a shape of the housing of the ink tank according to the present embodiment. FIG. 5 is a schematic diagram intended to better facilitate understanding of the parts constituting a joint unit 310 (FIG. 3) in the ink tank 100 to which the supply tube 40 illustrated in FIG. 2 is connected.

As illustrated in FIG. 3, roughly speaking, the ink tank 100 is constituted by a housing 130 for storing ink, a joint unit 310 connected with the printer 1, and a cover 150 for protecting the housing 130 and the joint unit 310. The joint unit 310 is constituted by a plurality of parts, which will respectively be described in more detail below.

Ink Tank Housing

As illustrated in FIG. 4, the housing 130 is rigid, and can directly store a liquid, such as an ink. The housing 130 has a bottom face portion 230, an upper face portion (not illustrated) opposite to the bottom face portion 230, and a plurality of opposing side face portions (not illustrated) that are adjacent to the lower and upper face portions. A face 130*a* on the ink supply port 105 side is shaped so as to include an opening 160 through which ink is poured and a plurality of side face portions 285 for increasing the ink storage capacity. A joint base 140 (FIG. 3) constituting the joint unit 310 is welded to the opening 160 of the housing 130.

In consideration of usability, the mounting direction of the ink tank 100 is defined such that the ink tank 100 can be mounted in an approximately horizontal direction to the printer 1 when the printer has been placed. Further, to ensure that there is as little ink remaining in the ink tank 100 as possible, as illustrated in FIGS. 3 and 5, the opening 160 corresponding to the ink supply port 105, which serves as a liquid supply port, is provided at the bottommost portion of the side face 130*a* of the housing 130 of the ink tank 100.

However, if the ink supply port 105 is provided at the bottommost portion of the side face 130*a* of the housing 130 of the ink tank 100, when the ink tank 100 is dropped, there are possibilities that the ink supply port 105 surroundings are damaged and ink leaks. Therefore, the cover 150 is attached to cover the surroundings. Further, the posture of the ink tank when the tank is mounted is stabilized by receiving a portion of the ink tank 100 with the bottom face of the cover 150.

Further, for a large-scale printer 1 that consumes a large amount of ink, to reduce the replacement frequency of the ink tank 100, the capacity of the ink tank 100 is often increased, and the width of the ink tank 100 in the direction orthogonal to the tank mounting direction is often widened. In this case, the distance from the ink supply port 105 to the edge of that width increases, so that when the ink tank 100 is mounted on the printer 1, the amount of ink that remains until the end without being used increases. To reduce the amount of this remaining ink as much as possible, it is desirable to make the width of the tank bottom face 230 in the direction orthogonal to the tank mounting direction narrower. However, if this width is narrowed too much, the tank posture when the tank is mounted becomes unstable, so that there is a possibility that the supply tube 40 and the ink supply port 105 are not be reliably connected. Consequently, an unnecessary force is applied on the connection portion, which can cause ink to leak from the connection portion. In a worst case scenario, the supply tube 40 may bend or break.

Figure 6:
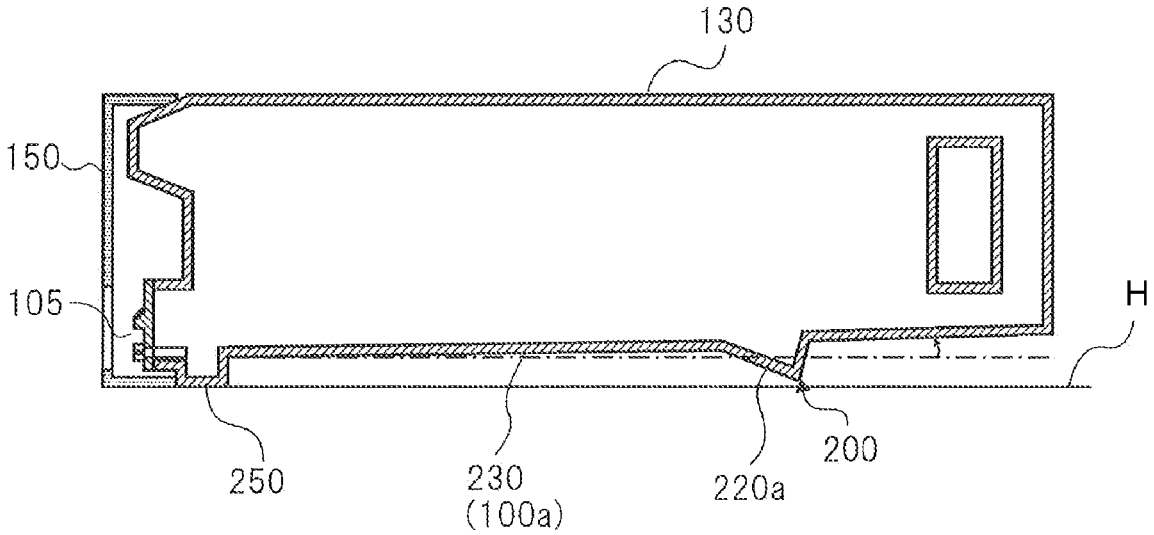
FIG. 6 is a schematic diagram explaining a cross-section taken along a line A-A after the component parts of FIG. 3 of ink tank according to an embodiment of the invention are assembled.

Therefore, as illustrated in FIG. 4, a first protrusion 220 is projectingly provided close to the end opposite to the opening 160 on the tank bottom face 230. In addition, as illustrated in FIG. 6, the tank bottom face 230 is formed at an incline towards the opening 160 of the housing 130 with respect to a virtual face (the dashed-dotted line in FIG. 6) that is parallel to a tank placement face H (the horizontal bottom face 10*a*) in the ink tank connection unit 10. Consequently, the amount of ink that remains until the end without being used can be reduced.

Further, a second protrusion 250 is provided close to the end at the opening 160 side on the tank bottom face 230. A side face of this second protrusion 250 engages with a locking member (not illustrated) on the printer 1, so that the ink tank 100 can be fixed to the printer 1.

In the present embodiment, an inclined face 220*a* of the first protrusion 220 is designed to be as long as possible in the tank insertion direction so that the first protrusion 220 is not caught when inserting the ink tank 100 into the ink tank connection unit 10, thereby preventing mounting mistakes.

Further, although in FIG. 4 the first protrusion 220 has a quadrangular pyramid shape, the first protrusion 220 is not limited to that shape. The first protrusion 220 may also be formed as illustrated in FIGS. 7A to 7C.

Figure 7A:
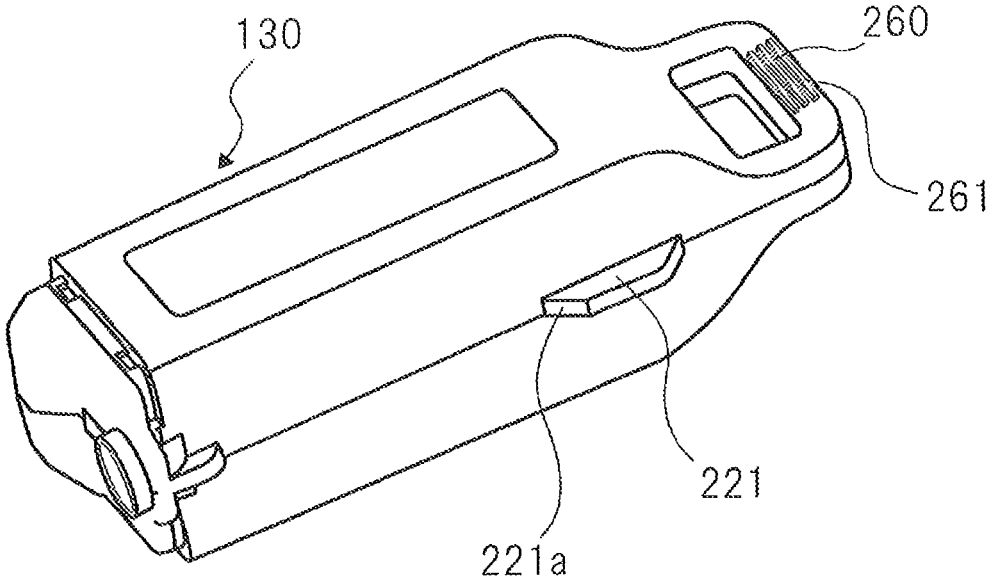
FIG. 7A is perspective view explaining modified examples of the housing of the ink tank according to an embodiment of the invention.

The first protrusion 221 illustrated in FIG. 7A is formed with the above-described first protrusion 220 in a rib shape. In this case, since the concavity in the housing 130 due to the first protrusion 220 disappears, the amount of remaining ink can be reduced.

Figure 7B:
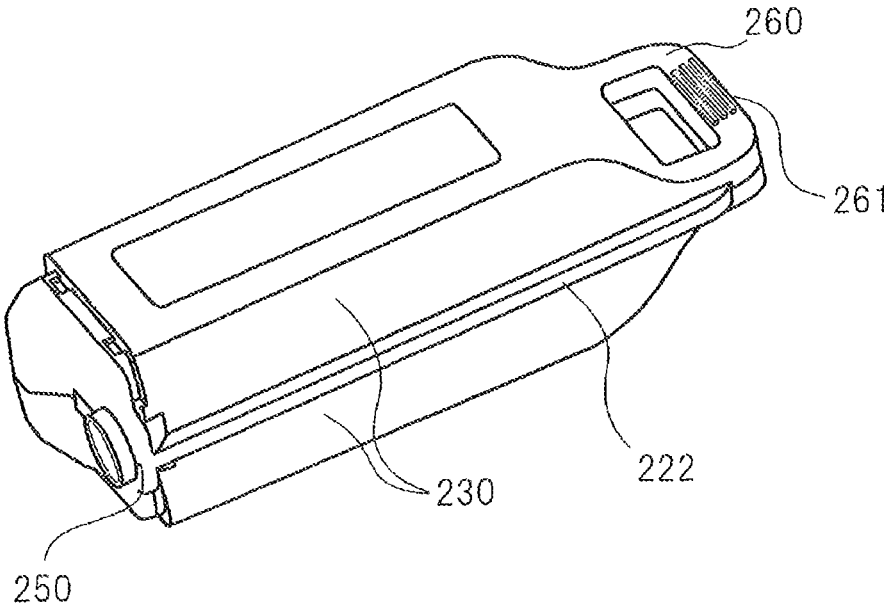
FIG. 7B is perspective view explaining modified examples of the housing of the ink tank according to an embodiment of the invention.
Figure 7C:
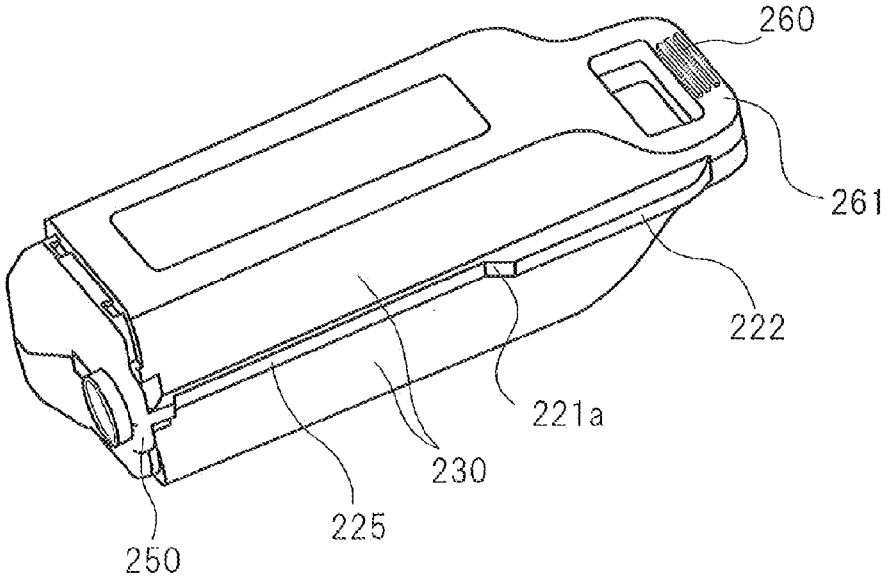
FIG. 7C is perspective view explaining modified examples of the housing of the ink tank according to an embodiment of the invention.
Figure 8:
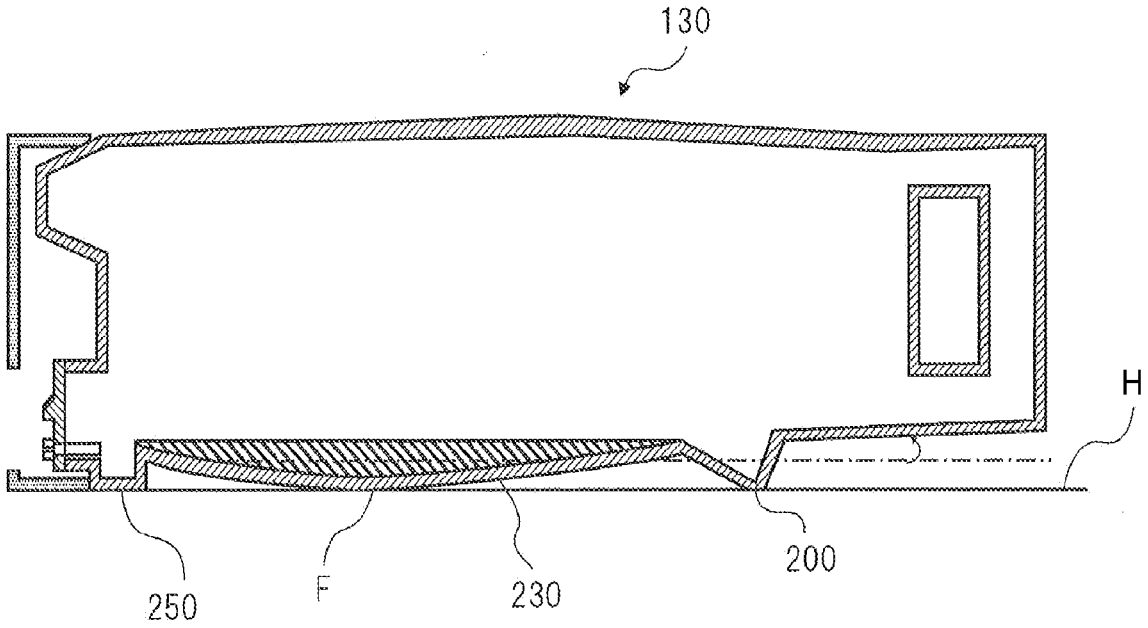
FIG. 8 is a schematic diagram illustrating a deformed state during distribution of the ink tank according to an embodiment of the invention.

The first protrusion 222 illustrated in FIG. 7B has a shape in which the first protrusion 221 illustrated in FIG. 7A and the second protrusion 250 are joined by a rib having the same height as the first protrusion, with the first protrusion 221 extending toward a gripping portion 260 side. Thus, by providing a rib-shaped section substantially along the whole length of the tank bottom face 230, the rigidity of the tank bottom face 230 is increased so that the increase in the amount of remaining ink when the ink runs out due to deformation of the tank bottom face 230 can be suppressed. More specifically, deformation (bulging) of the tank bottom face 230 due to an increase in the internal pressure caused by expansion of the interior atmosphere and due to the weight of the ink that occur, for example, when an ink tank is left for a long period of time in a high-temperature environment is suppressed, thereby allowing the occurrence of puddles of ink (hatched line portion F in FIG. 8) to be prevented.

In addition, according to the configuration of FIG. 7B, an inclined face (reference numeral 220*a* in FIG. 6 and reference numeral 221*a* in FIG. 7A) is not formed on the first protrusion 222. Therefore, the ink tank 100 can be smoothly mounted without the first protrusion 222 being caught.

However, for such a tank having an greatly increased capacity, a person's hands are sometimes placed on the tank bottom face 230 when carrying the tank. Depending on the height of the first protrusion 222, unpleasant feeling might be caused.

In such a case, as illustrated in FIG. 7C, the tank can be made to be readily carried by providing a concavity 225 on part of the first protrusion 222. Further, if a concave portion 225 is formed as a rib so as to protrude beyond the tank bottom face 230, the rigidity of the tank bottom face 230 can be ensured, and an increase in the amount of remaining ink can be suppressed.

In addition, similar to the inclined face 220*a* of the first protrusion 220 illustrated in FIG. 6, to prevent the above-described mounting mistake, the inclined faces 221*a* and 221*a* illustrated in FIGS. 7A and 7C may obviously also be lengthened as much as possible.

To improve user handleability when carrying the tank or when removing the tank from the ink tank unit, a gripping portion 260 is provided on the side opposite to the side on which the opening 160 of the housing 130 of the ink tank 100 is formed. The gripping portion 260 is made by forming a through hole in the housing 130.

In the present embodiment, the peripheral portion around the through hole forming the gripping portion 260 is constituted by a hollow body that is capable of accommodating ink and is in communication with the housing interior. Ink can also be filled in the hollow body, which enables the ink storage capacity of the ink tank 100 to be increased by that amount.

A plurality of ribs 261 like those illustrated in FIGS. 7A to 7C may be provided on the gripping portion 260. These ribs 261 act to suppress gripping portion 260 slippage, thereby further improving user handleability.

Joint Unit (Joint Member)

The joint unit 310 is joined to the opening 160 of the housing 130 of the ink tank 100. In the following description, a configuration in which the joint unit 310 is attached to the housing 130, as illustrated in FIG. 3, will be referred to as a "housing unit 300".

The joint unit 310, which is attached to the housing 130, includes a valve mechanism for opening and closing the ink supply port 105 that supplies the ink to the printer 1. A regulating body 165 is provided in an opening that corresponds to the ink supply port 105 provided on the joint base 140. A spring 170, a valve 180, and a sealing member 190 are provided in that order in the regulating body 165.

This configuration will now be described in more detail. As illustrated in FIG. 5, the joint base 140 has the spring 170 as an elastic member and the valve 180 as a valve included therein. Further, the joint base 140 is provided with a cylindrical-shaped regulating body 165 having a bottom to regulate the movement of the valve 180. When the joint unit 310 is attached to the housing 130, part of the regulating body 165 is arranged on the inner side of the ink tank 100. A circular rib 166 provided so as to surround a tubular hole of the regulating body 165 is arranged on the side opposite to the side on which the regulating body 165 of the joint base 140 is provided. The circular rib 166 forms an opening that is larger than the tubular hole of the regulating body 165. The sealing member 190 is inserted into such a circular rib 166. On the other hand, in the regulating body 165, the valve 180 is arranged so as to be urged by the spring 170 and to be pressed against the sealing member 190. A cap 200 covers the circular rib 166 so that the sealing member 190 does not get out from the circular rib 166 due to the force from the spring 170, whereby the sealing member 190 is fixed. An opening to serve as an ink supply port is formed in the center of the cap 200.

The sealing member 190 is a circular structure through a center of which a hole passes, and is provided with a convex rib (not illustrated) around the outer circumference thereof so as to be reliably and tightly attached to the inner circumference of the circular rib 166 of the joint base 140. This convex rib enables atmosphere tightness between the sealing member 190 and the joint base 140 to be achieved.

Thus, by tightly attaching the sealing member 190 to the joint base 140 and properly pressing the valve 180 against the sealing member 190, ink leakage from the housing unit 300 and ink denaturation due to evaporation and the like are suppressed.

The sealing member 190 is constituted by, for example, flexible material, such as a rubber material like butyl rubber or a thermoplastic resin material like an elastomer.

Further, as illustrated in FIG. 5, an opening 270 is provided on a portion positioned more upward than the spring 170 of the regulating body 165 when the ink tank 100 is mounted on the ink tank connection unit 10. Consequently, when the supply tube 40 is inserted into the regulating body 165 of the joint unit 310 via the ink supply port 105, the atmosphere introduced into the regulating body 165 from the atmosphere introduction port 30 of the supply tube 40 that is in communication with the outside atmosphere can easily come out from the regulating body 165 via the opening 270. More specifically, providing the opening 270 improves atmosphere releasability.

Further, as illustrated in FIG. 3, an information storage medium 210 is fixed to the joint base 140. The information storage medium 210 stores information about the ink in the ink tank 100 (for example, the physical properties of the ink, the amount of remaining ink and the like) and enables information to be transmitted to the outside. To correctly position the supply tube 40 on the ink tank connection unit 10 side and the ink supply port 105 on the ink tank 100 side, positioning guide apertures 280 and 290 are arranged on the joint base 140. Further, two guide pins (not illustrated) that are inserted into these guide apertures are provided on the ink tank connection unit 10. The positioning accuracy of these positioning guide apertures 280 and 290 improves as they are closer to the ink supply port 105.

Figure 9:
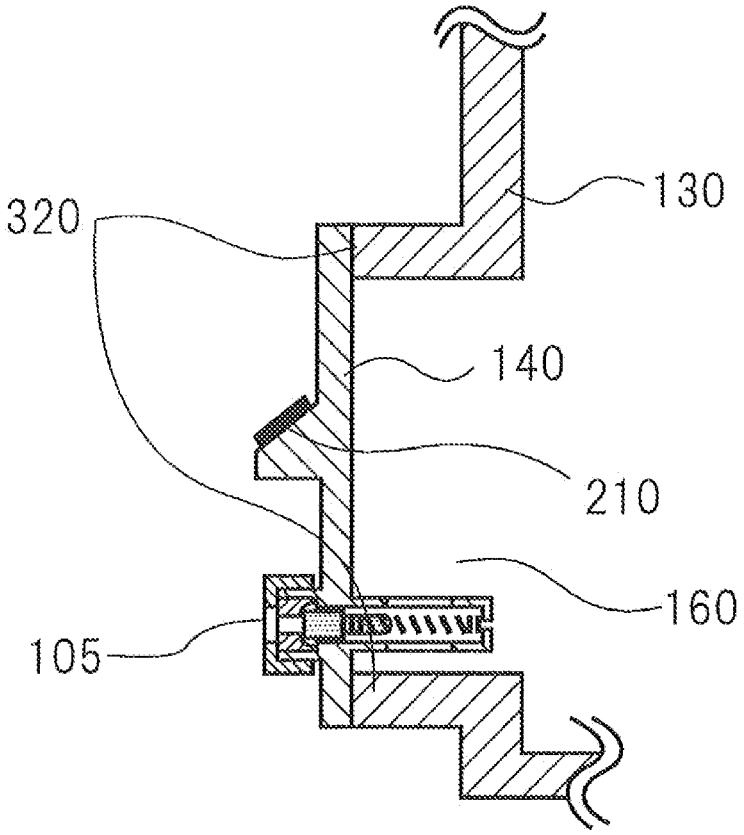
FIG. 9 is a schematic diagram explaining the vicinity of the weld rib of the housing of the ink tank according to an embodiment of the invention.

In addition, as illustrated in FIG. 9, a weld rib 320 for welding the joint base 140 is formed on the periphery of the opening 160 of the housing 130 so as to protrude. The information storage medium 210 on the joint base 140 and the ink supply port 105 are arranged at a position that is inner side of the enclosure formed by the weld rib 320. Consequently, the shape of the housing 130 does not change even if a force acts in the connection direction when an electrical connector (described below) and the supply tube 40 on the printer 1 side are connected to the joint unit 310 (the ink tank 100). This is because, in the present embodiment, a stronger state can be maintained with a thickness equivalent to the height in the protrusion direction of the weld rib 320. Consequently, a reliable connection can be achieved between the electrical connector (described below) and the supply tube 40 on the printer 1 side and the information storage medium 210 and the ink supply port 105 on the ink tank 100 side, thereby removing concerns about electrical connection defects and ink leakage.

Figure 10:
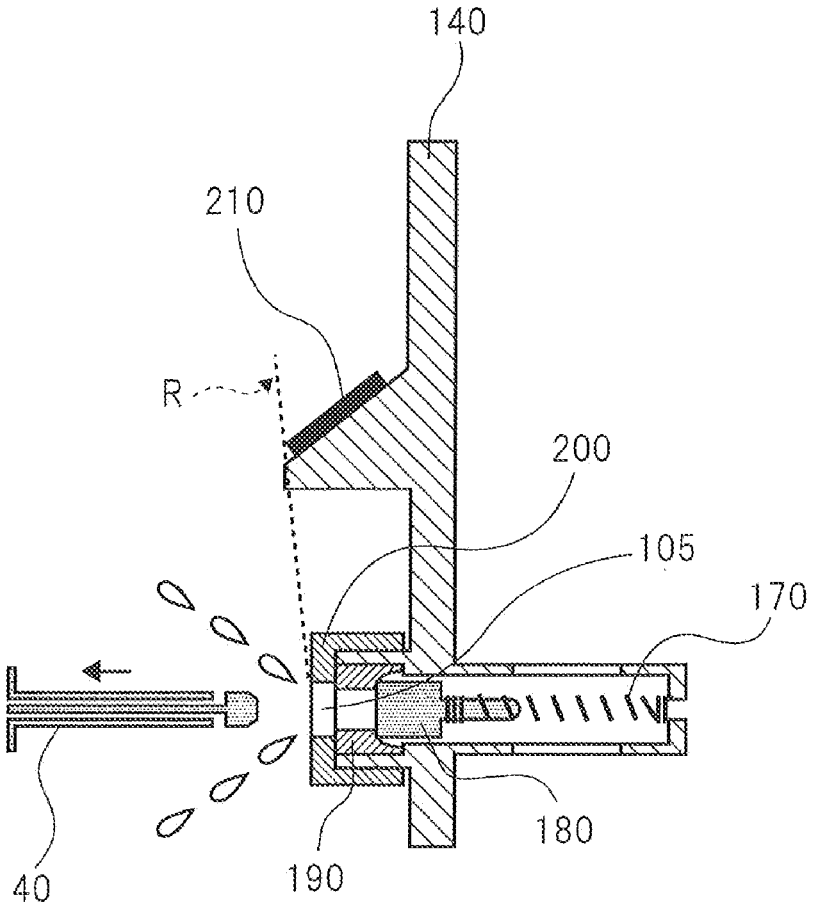
FIG. 10 is a schematic diagram explaining connection between the information storage medium and the ink supply port of the ink tank, and the recording apparatus main body in a state immediately after removal of the ink tank, according to an embodiment of the invention.

As illustrated in FIG. 10, the information storage medium 210 is arranged so that, when the ink tank 100 is mounted on the ink tank connection unit 10, a connection face (electrical connection portion) with an electrical connector 330 faces upward, and is positioned higher than the ink supply port 105. Further, as illustrated by the dotted line R, the edge on the printer 1 side of the information storage medium 210 is arranged at a position which protrudes further out than the cap 200 of the ink supply port 105. By arranging in a manner as above, when ink is scattered from the ink supply port 105 during mounting or removing the ink tank 100, because the ink supply port 105 is on the back side of the connection face of the information storage medium 210 with the electrical connector 330, ink adhesion onto the information storage medium 210 can be prevented.

Figure 11:
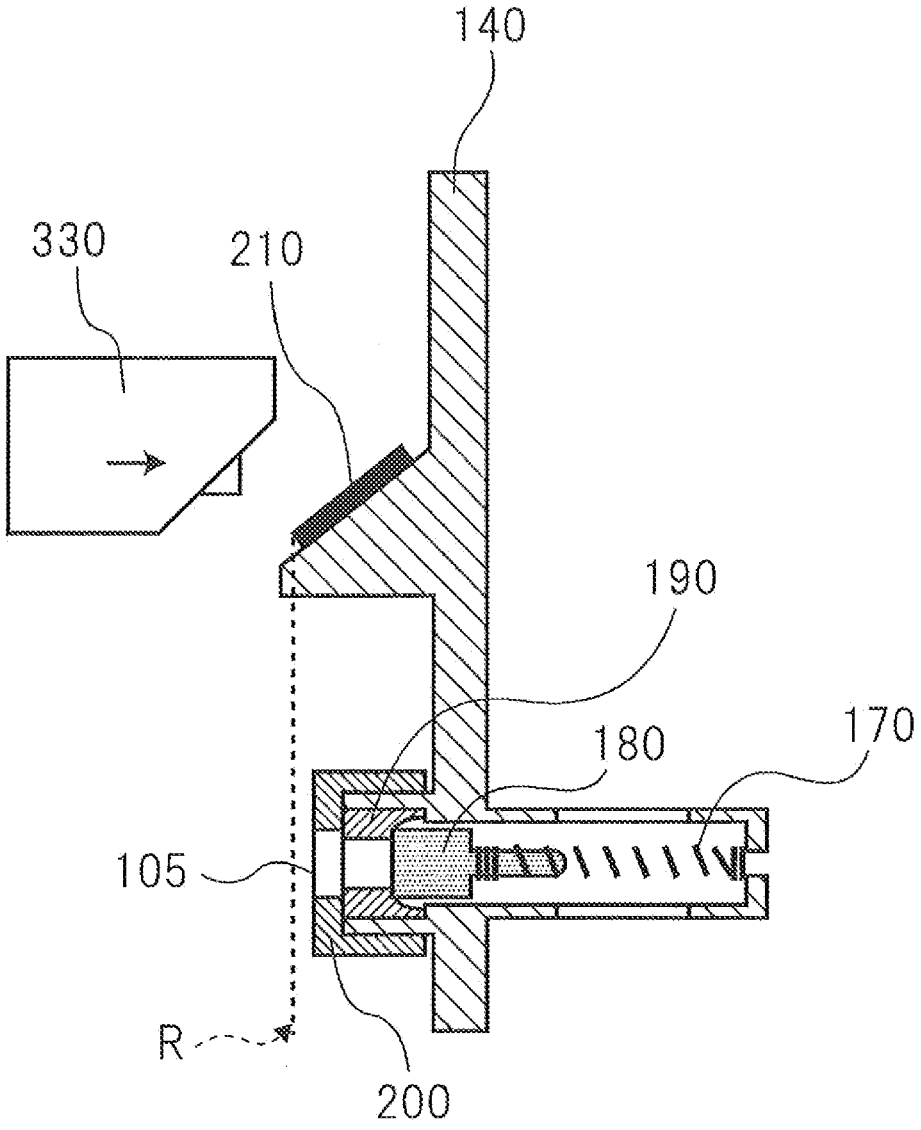
FIG. 11 is a view illustrating connection between the information storage medium and the ink supply port of the ink tank, and the recording apparatus main body in a state immediately before mounting of the ink tank, according to an embodiment of the invention.

In addition, as illustrated in FIG. 11, the connection face of the information storage medium 210 with the electrical connector 330 is arranged at an incline with respect to the connection direction of the electrical connector 330. By arranging in this manner, the contact point part of the electrical connector 330 to the connection face of the information storage medium 210 with the electrical connector 330 can be contacted from the front by a mounting operation in the horizontal direction of the ink tank 100. Consequently, the movement amount of the contact point part during electrical connection can be reduced, which enables the life of the contact point part of the electrical connector 330, which is the connection member, to be extended. Consequently, prevention of ink adhesion onto the information storage medium 210 can be achieved simultaneously with realizing an extension in the life of the contact point part of the electrical connector 330.

Figure 12:
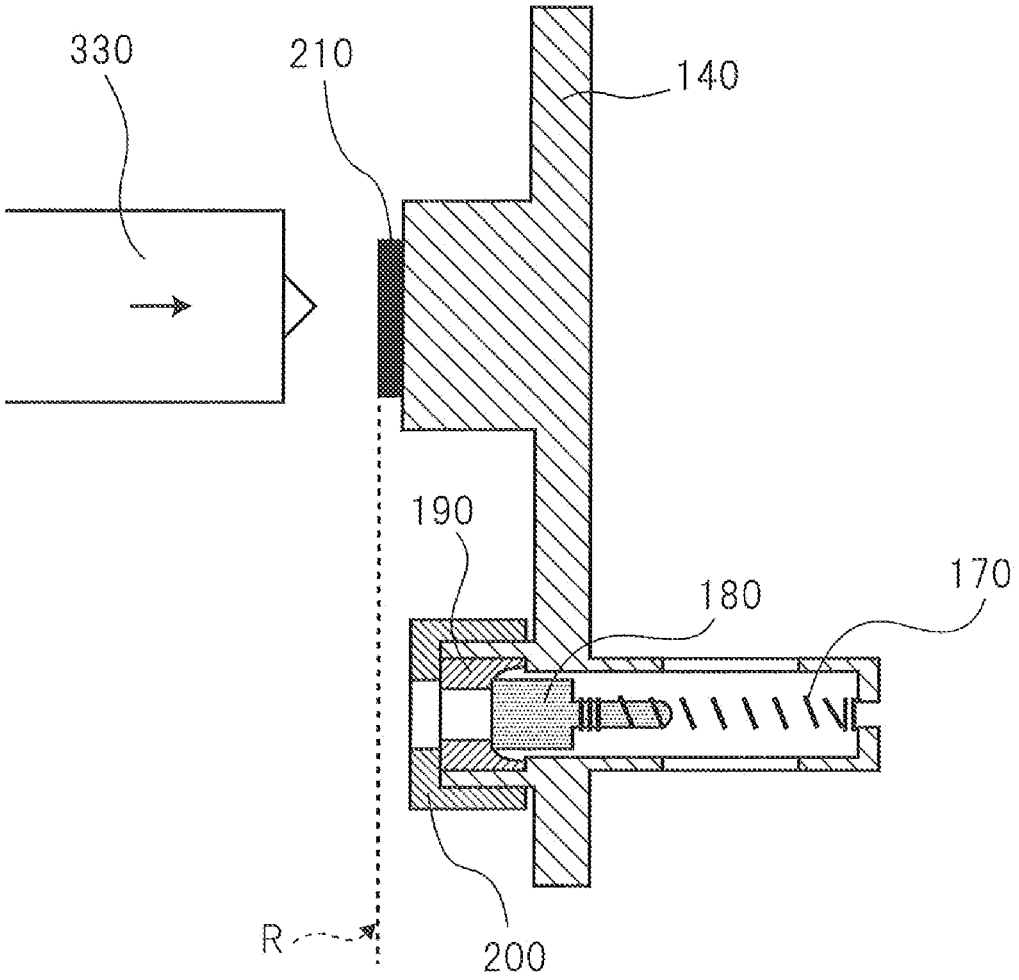
FIG. 12 is a view illustrating connection between the information storage medium and the ink supply port of the ink tank, and the recording apparatus main body in a case where the mounted position of the information storage medium extends in a direction perpendicular to the ink tank mounting direction according to an embodiment of the invention.

Moreover, as illustrated in FIG. 12, the life of the contact point part of the electrical connector 330 can be extended even when the connection face of the information storage medium 210 with the electrical connector 330 extends in a vertical direction with respect to the connection direction of the electrical connector 330. However, when considering how to deal with ink adhesion onto the information storage medium 210, like in the example of FIG. 10, it is preferable to make the connection face with the electrical connector 330 face upward.

Cover

As illustrated in FIG. 3, to protect the side face portions 285 and the joint unit 310 of the housing 130, a cover 150 is attached to the housing 130. This cover 150 has a plurality of holes 151 for preventing mistaken mounting.

The cover 150 in the present embodiment includes a flat face portion 152 that has a difference in level, so that if the ink tank is accidentally dropped, the ink supply port 105 does not directly hit the floor. Further, since the cover 150 is a part that has nothing to do with liquid-contact properties, it is formed from acrylonitrile butadiene styrene, which has strong dropping resistance and heat resistance.

Next, the assembly of the housing 130 and joint unit 310 of the ink tank will be described.

The housing 130 has the opening 160. The weld rib 320 protrudes along the periphery of the opening 160. The joint base 140 is attached to the rib, and the joint base 140 and the housing 130 are welded together. Subsequently, the spring 170, the valve 180, the sealing member 190, and the cap 200 are assembled in that order in the regulating body 165 of the joint base 140, whereby the assembly of the housing 130 and the joint unit 310 is completed.

The opening 160 is arranged at a section of the housing 130 that corresponds to the ink supply port 105. The sealing member 190, the valve 180, and the spring 170 are arranged on the inner side of this opening 160. With this configuration, the ink tank 100 is essentially sealed.

Next, the structure of the portion connected with the ink tank 100 of the printer 1 will be described in more detail with reference to FIGS. 2 and 13.

When the ink tank 100 is mounted on the ink tank connection unit 10 of the printer 1, the tip of the supply tube 40 is inserted into the opening of the sealing member 190 while widening the sealing member 190, and abuts to the valve 180.

By thus widening the sealing member 190, the seal properties between the supply tube 40 and the sealing member 190 are ensured.

From this state, if the ink tank 100 is further pushed toward the printer 1 side (the side face 10*b* side of the housing of the ink tank connection unit 10), the valve 180 is pushed by the supply tube 40 into the interior of the housing 130, and the ink lead-out port 20 and the atmosphere introduction port 30 provided near the tip of the supply tube 40 are connected to the ink in the housing 130.

As above, when the ink tank 100 is mounted on the printer 1, the outer circumference of the supply tube 40 included in the printer 1 and the inner circumference of the sealing member 190 of the ink tank 100 are tightly sealed together. Consequently, the ink lead-out port 20 and the atmosphere introduction port 30 of the supply tube 40 are in communication with the housing 130 of the ink tank 100.

By configuring in this manner, ink extraction and atmosphere introduction can be carried out at the same location, so that there is only one sealing section between the supply tube 40 and the sealing member 190. Therefore, the positional accuracy of the supply tube 40 and the sealing member 190 is readily ensured, so that reliability against ink leakage can be enhanced.

In the connection state described above, the ink supply operation is performed based on the following steps.

Figure 13:
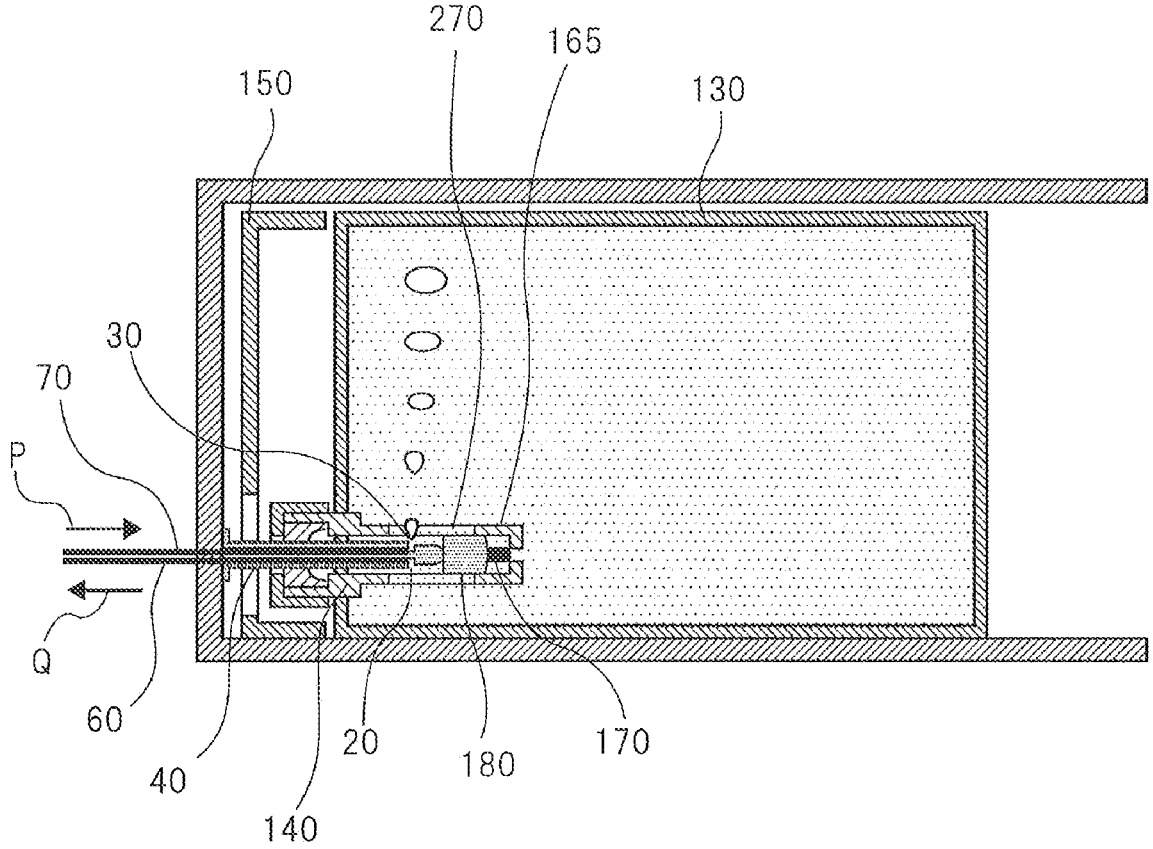
FIG. 13 is a schematic diagram explaining a state where the ink tank is mounted on the ink jet printer and atmosphere is introduced into the ink tank housing simultaneously with leading-out of ink according to an embodiment of the invention.
Figure 14:
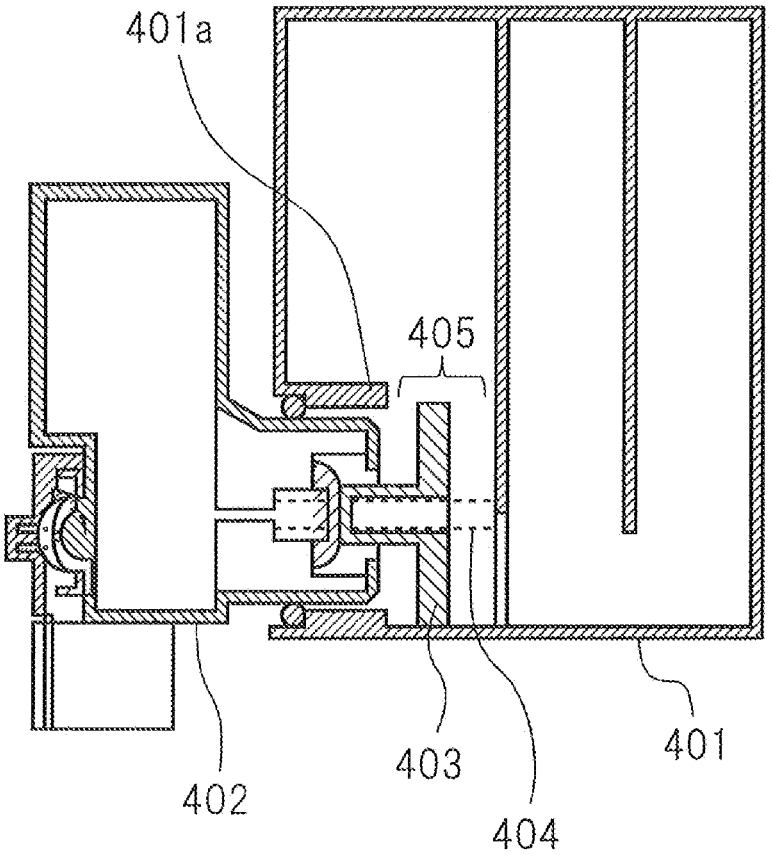
FIG. 14 is a schematic diagram explaining a conventional ink tank disclosed in WO2000/003877 pamphlet.
Figure 15:
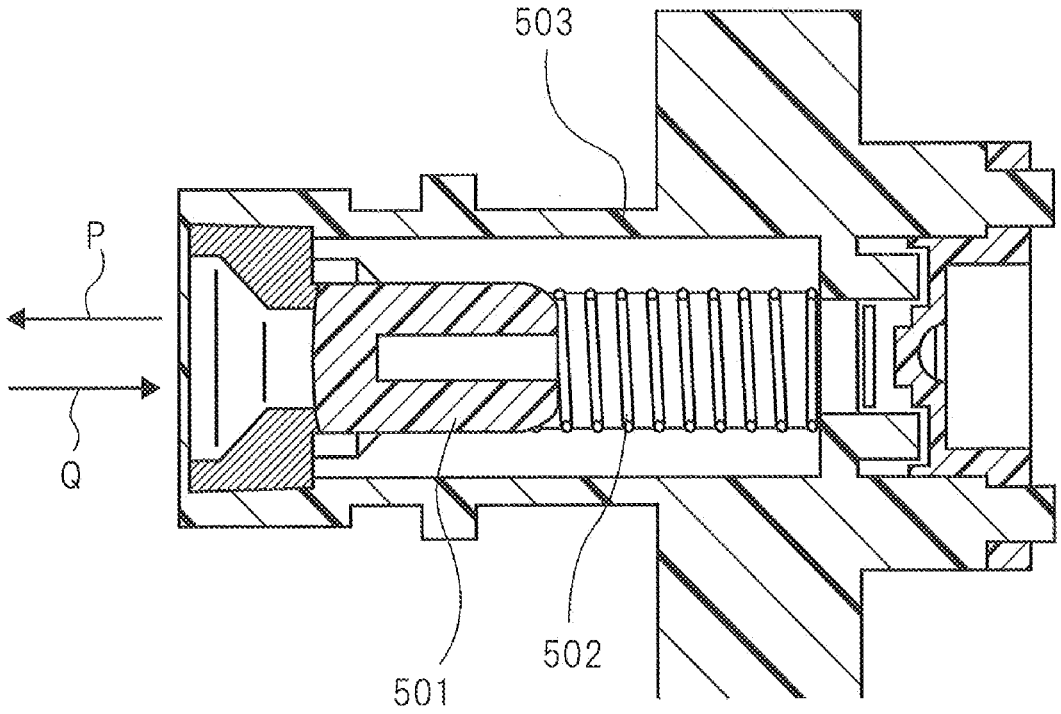
FIG. 15 is a schematic diagram explaining a connection portion of a conventional ink tank with a sealing valve disclosed in Japanese Patent Application Laid-Open No. 2004-291246.

Describing this with reference to FIGS. 2 and 13, due to a suction action by the pump 80, the ink in the housing 130 constituting the ink tank 100 passes through the ink lead-out port 20 arranged on the supply tube 40 of the printer 1, then passes through the ink tube 60, and is supplied to a sub-tank 120. At this stage, simultaneously with the ink being expelled from the housing 130 as illustrated by arrow Q, atmosphere is introduced as illustrated by arrow P in FIG. 13 into the housing 130 from the atmosphere introduction port 30 of the supply tube 40 via the atmosphere tube 70 on the printer 1 side, thereby allowing a stable ink supply.

The ink supplied to the sub-tank 120 is supplied to the recording head 50 via the sub-tank 120, and is emitted from the plurality of ink discharge nozzles provided on the recording head 50.

As described above, according to the ink tank described in the present embodiment, at the connection portion between the ink tank 100 and the supply tube 40 on the printer 1 side, positional deviation of the valve 180 during a valve opening/closing movement can be regulated by the regulating body 165. In addition, bubble releasability during the introduction of atmosphere into the ink tank 100 is improved, so that ink can be stably supplied to the recording head 50. Further, as described above, even if the ink tank 100 is accidentally dropped onto the floor, since positional deviation of the valve 180 is prevented by the regulating body 165, the reliability of the seal properties between the valve 180 and the sealing member 190 also improves. Consequently, concerns of ink scatter onto the user or the floor can also be resolved.

Further, since the seal section between the supply tube 40 and the sealing member 190 forms a seal on the side in which the diameter in the direction orthogonal to the insertion direction of the ink tank is constricted, stable seal properties can be ensured thorough the mounting stroke of the ink tank 100 to the tank connection unit 10.

In addition, like in the present embodiment, by employing a connection unit configuration in which the ink lead-out port and the atmosphere introduction port are integrated as one part, the costs of the recording apparatus can be decreased due to simplification of the constituent parts.

Furthermore, the supply tube 40 of the tank connection unit 10 does not have to be integrated. The effects of the present invention can also exhibit even if the supply tube 40 is configured as a separate structure.

The above-described embodiment was described using a configuration in which the position that the supply tube 40 is stuck into the ink tank 100 is arranged at the bottommost portion of the side face 130*a* of the housing 130. However, obviously, the position does not have to be arranged at the side face bottommost portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-085990, filed Apr. 2, 2010, and No. 2010-187156 filed Aug. 24, 2010, which are hereby incorporated by reference herein in their entirety.

REFERENCE SIGNS LIST

1 ink jet printer
10 connection unit
20 ink lead-out port
30 atmosphere introduction port
40 supply tube
50 recording head
100 ink tank
105 ink supply port
130 housing
140 joint base
160 opening of housing
165 regulating body
170 spring
180 valve
190 sealing member
210 information storage medium
230 tank bottom face
270 opening of regulating body
310 joint unit

The invention claimed is:

1. A tank comprising:

a housing for storing a liquid;

a liquid supply port;

a valve which is arranged in the housing, and which is urged by an elastic member toward the liquid supply port to close the liquid supply port; and a regulating body, which includes the elastic member and the valve thereinside, for regulating movement of the valve, wherein:

in a state in which a supply tube passes through the liquid supply port and is inserted into an inner side of the regulating body, atmosphere is introduced into the housing from the supply tube and a liquid is led out from the supply tube, the liquid supply port is positioned on a side face of the tank in use adjacent to a bottom face of the housing in use, the regulating body extends along the bottom face of the housing and includes an opening, the supply tube includes a liquid lead-out port for guiding a liquid and an atmosphere introduction port for introducing atmosphere, and in a state in which the supply tube passes through the liquid supply port and is inserted into an inner side of the regulating body, and proceeding in a vertical direction from the bottom face, the liquid lead-out port, the atmosphere introduction port and the opening are positioned vertically in order of the liquid lead-out port, then the atmosphere introduction port, and then the opening.

2. A tank according to claim 1, wherein the liquid supply port includes a sealing member which has a hole into which the supply tube can be inserted, and the valve urged by the elastic member toward the liquid supply port so as to close the hole abuts to the sealing member.

3. A tank according to claim 1, wherein in a state in which the supply tube passes through the liquid supply port and is inserted into an inner side of the regulating body, the opening of the regulating body is provided at a position facing a portion of the supply tube where the atmosphere introduction port is provided.

4. A tank according to claim 1, wherein the side face of the housing has an information storage medium, at least a portion of the information storage medium protrudes further toward an external side of the side face than a periphery of the liquid supply port.

5. A tank according to claim 4, wherein the information storage medium is arranged at an incline with respect to the side face of the housing.

6. A tank according to claim 4, further comprising:

an opening formed on the side face of the housing for arranging the regulating body that includes the elastic member and the valve inside the housing; and a joint member which is joined to a periphery of the opening and has the liquid supply port and the information storage medium, wherein the liquid supply port and the information storage medium are positioned inside a portion of the joint member jointed to the periphery of the opening.

7. A tank according to claim 1, wherein the liquid supply port is positioned on an end on the bottom face side on the side face of the housing, and the bottom face of the housing is inclined so that a liquid flows toward the liquid supply port in a state where the tank is placed in a horizontal plane.

8. A printer comprising:

a liquid discharge head for discharging a liquid;

a tank which includes a housing for storing a liquid that is discharged by the liquid discharge head, a liquid supply port for supplying a liquid externally from the housing, a valve which is arranged in the housing and is urged by an elastic member toward the liquid supply port to close the liquid supply port, and a regulating body which includes the elastic member and the valve thereinside and which regulates movement of the valve; and a connection unit to which the tank is connected, which includes a supply tube that is inserted through the liquid supply port into an inner side of the regulating body when the tank is connected, the supply tube having a liquid lead-out port for leading out a liquid from inside the housing to the liquid discharge head and an atmosphere introduction port for introducing atmosphere into the housing along with the leading-out of the liquid, wherein:

the liquid supply port is positioned on a side face of the tank in use adjacent to a bottom face of the housing, and the regulating body extends along the bottom face of the housing and includes an opening, the supply tube includes a liquid lead-out port for guiding a liquid and an atmosphere introduction port for introducing atmosphere, the supply tube is configured so that the liquid lead-out port is arranged downwards and the atmosphere introduction port is arranged upward with respect to the vertical direction, in a state in which the supply tube passes through the liquid supply port and is inserted into an inner side of the regulating body, and proceeding in a vertical direction from the bottom face, the liquid lead-out port, the atmosphere introduction port and the opening are positioned vertically in order of the liquid lead-out port, then the atmosphere introduction port, and then the opening, and in a state in which the tank is connected to the connection unit and the supply tube passes through the liquid supply port and is inserted into an inner side of the regulating body, the opening of the regulating body is configured so as to face a portion of the supply tube where the atmosphere introduction port is provided.

9. A printer according to claim 8, wherein the side face of the housing has an information storage medium, at least a portion of the information storage medium protruding further toward an external side with respect to the side face than a periphery of the liquid supply port, and the information storage medium is arranged at an incline with respect to the side face of the housing, and the connection unit has a connection portion that includes a contact point to be connected to the information storage medium, the connection portion being arranged at an incline so as to be connected with the information storage medium when the tank is connected to the connection unit of the tank.

10. A tank according to claim 1, wherein in a state in which the supply tube is not inserted into the inner side of the regulating body, the opening communicates an inside of the regulating body with an inside of the housing.

* * * * *